US005890118A

United States Patent [19]

Kagoshima et al.

[11] Patent Number: 5,890,118

[45] Date of Patent: Mar. 30, 1999

[54] INTERPOLATING BETWEEN REPRESENTATIVE FRAME WAVEFORMS OF A PREDICTION ERROR SIGNAL FOR SPEECH SYNTHESIS

[75] Inventors: Takehiko Kagoshima, Tokyo; Masami Akamine, Yokosuka, both of Japan

[73] Assignee: Kabushiki Kaisha Toshiba, Kawasaki, Japan

[21] Appl. No.: 613,093

[22] Filed: Mar. 8, 1996

[30] Foreign Application Priority Data

Mar. 16, 1995 [JP] Japan ..... 7-057773

[51] Int. Cl.[6] ..... G10L 9/04

[52] U.S. Cl. ..... 704/265; 704/207; 704/223; 704/261

[58] Field of Search ..... 395/2.74, 2.77, 395/2.76, 2.69; 704/261, 258, 207, 208, 262, 264, 221, 222, 223, 219

[56] References Cited

U.S. PATENT DOCUMENTS

| | | | |
|---|---|---|---|
| 4,521,907 | 6/1985 | Amir et al. | 704/262 |
| 4,692,941 | 9/1987 | Jacks et al. | 395/2.69 |
| 4,797,926 | 1/1989 | Bronson et al. | 395/2.23 |
| 4,937,873 | 6/1990 | McAulay et al. | 395/2.74 |
| 5,119,424 | 6/1992 | Asakawa et al. | 704/208 |
| 5,517,595 | 5/1996 | Kleijn | 395/2.14 |

OTHER PUBLICATIONS

W. B. Kleijn, et al., "Methods for Waveform Interpolation in Speech Coding", Digital Signal Processing vol. 1, No. 4, (pp. 215–230), 1991.

*Primary Examiner*—David R. Hudspeth
*Assistant Examiner*—Donald L. Storm
*Attorney, Agent, or Firm*—Oblon, Spivak, McClelland, Maier & Neustadt, P.C.

[57] ABSTRACT

A speech synthesis apparatus includes; a memory for storing a plurality of typical waveforms corresponding to a plurality of frames, the typical waveforms each previously obtained by extracting in units of at least one frame from a prediction error signal formed in predetermined units, a voiced speech source generator including an interpolation circuit for performing interpolation between the typical waveforms read out from the memory means to obtain a plurality of interpolation signals each having at least one of an interpolation pitch period and a signal level which changes smoothly between the corresponding frames, a superposition circuit for superposing the interpolation signals obtained by the interpolation circuit to form a voiced speech source signal, an unvoiced speech source generator for generating an unvoiced speech source signal, and a vocal tract filter selectively driven by the voiced speech source signal outputted from the voiced speech source generator and the unvoiced speech source signal from the unvoiced speech source generator to generate synthetic speech. Further, interpolation positions can be determined bases on the pitch period.

19 Claims, 7 Drawing Sheets

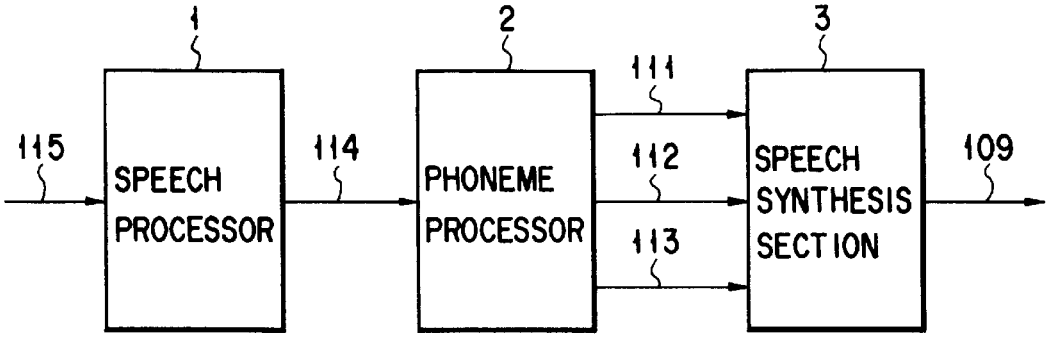
FIG. 1
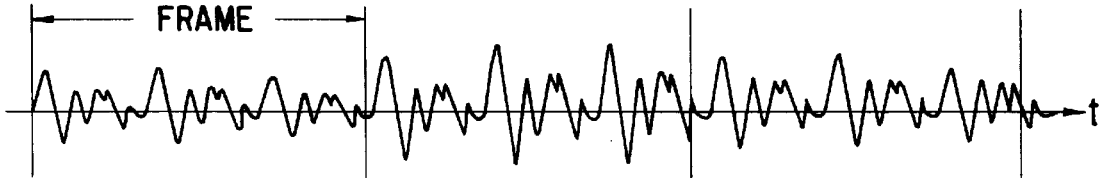
FIG. 3A SPEECH SIGNAL
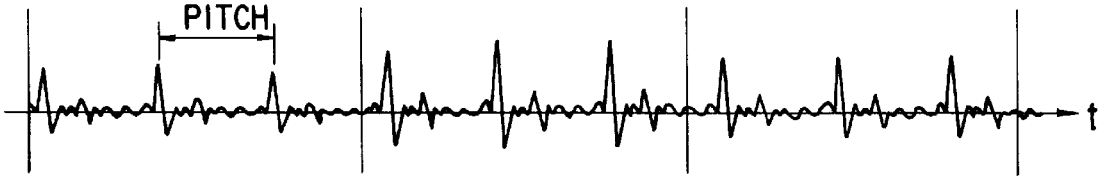
FIG. 3B RESIDUAL SIGNAL
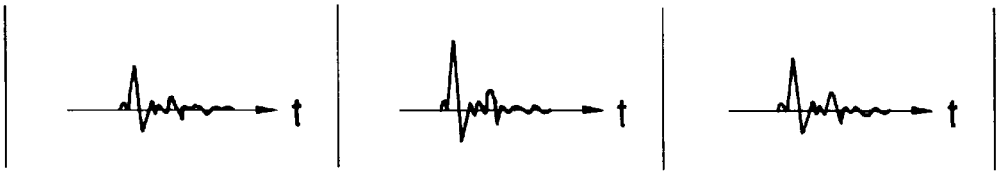
FIG. 3C TYPICAL WAVEFORM

INTERPOLATING BETWEEN REPRESENTATIVE FRAME WAVEFORMS OF A PREDICTION ERROR SIGNAL FOR SPEECH SYNTHESIS

BACKGROUND OF THE INVENTION

1. Field of the Invention

The present invention relates to a speech synthesis apparatus that produces synthetic speech by driving a vocal tract filter according to a speech source signal, and more particularly to a speech synthesis apparatus that produces synthetic speech from pieces of information including phoneme symbol string, pitch, and phoneme duration for text-to-speech synthesis.

2. Description of the Related Art

The act of producing a speech signal artificially from a given sentence is known as text-to-speech synthesis. The text synthesis system usually comprises a speech processor, a phoneme processor, and a speech signal generator. The inputted text is subjected to Morphological analysis and syntax analysis at the speech processor. Next, the phoneme processor subjects the analysis results to accent processing and intonation processing to produce information including phoneme symbol strings, pitch patterns, phoneme duration, etc. Finally, the speech signal generator, or speech synthesis apparatus, selects feature parameters of small basic units (synthesis unit), including syllables, phonemes, and one-pitch intervals, according to such information as phoneme symbol strings, pitch patterns, and phoneme duration, connects them by controlling their pitch and duration, thereby producing synthetic speech.

One known speech synthesis apparatus that can synthesize any phoneme symbol string by controlling the pitch and phoneme duration is such that a residual waveform is used at the voiced speech source in the vocoder system. The vocoder system, as is well known, is a method of generating synthetic sound by modeling a speech signal in a manner that separates the speech signal into speech source information and vocal tract information. Normally, a voiced speech source is modeled into an impulse train and an unvoiced speech source is modeled by noise.

A conventional typical speech synthesis apparatus in the vocoder system comprises a frame information generator, a voiced speech source generator, an unvoiced speech source generator, and a vocal tract filter. According to the phoneme symbol string, pitch pattern, and phoneme duration, the frame information generator outputs frame average pitch, frame average power, voiced/unvoiced speech source information, and filter coefficient selecting information for each frame to be synthesized. Using the frame average pitch and frame average power, the voiced speech source generator generates a voiced speech source expressed by impulse trains spaced at regular frame average pitch intervals in a voiced interval judged on the basis of the voiced/unvoiced speech source information. Using the frame average power, the unvoiced speech source generator generates an unvoiced speech source expressed by white noise in an unvoiced interval judged on the basis of the voiced/unvoiced speech source information. The filter coefficient storage section outputs filter coefficients according to the filter coefficient selecting information. The vocal tract filter causes a voiced speech source or an unvoiced speech source to drive the vocal tract filter having the filter coefficient, and outputs synthetic speech.

Such a vocoder system loses a delicate feature for each pitch interval of voiced speech because impulse trains are used as a speech source, resulting in degradation of the sound quality of synthetic speech. To solve this problem, an improved method capable of preserving the minute structure of speech has been developed. The method uses as a voiced speech source signal a residual signal waveform indicating a prediction residual error obtained by analyzing speech with an inverse filter. Namely, by repeating a one-pitch-long residual signal waveform, instead of impulses, at regular frame average pitch intervals, a voiced speech source signal is generated. In this case, because the residual signal waveform must be changed according to the vocal tract characteristic, the residual signal waveform is changed frame by frame.

In the improved speech synthesis method, however, the voiced speech source signal is generated in a frame by repeating a typical waveform serving as the basis of the voiced speech source at regular pitch intervals, so that the residual signal waveform and the pitch are discontinuous at the boundary between frames, resulting in the problem that the phoneme of synthetic speech and the pitch change are unnatural.

SUMMARY OF THE INVENTION

The object of the present invention is to provide a speech synthesis apparatus capable of producing synthetic speech excellent in naturalness by reducing discontinuity at the boundary between frames.

According to the present invention, there is provided a speech synthesis apparatus comprising a memory for storing a plurality of typical waveforms corresponding to a plurality of frames, the typical waveforms each previously obtained by extracting in units of at least one frame from a prediction error signal formed in predetermined units, a voiced speech source generator including an interpolation circuit for performing interpolation between the typical waveforms read out from the memory means to obtain a plurality of interpolation signals each having at least one of an interpolation pitch period and a signal level which changes smoothly between the corresponding frames, and superposition means for superposing the interpolation signals obtained by the interpolation means to form a voiced speech source signal, an unvoiced speech source generator for generating an unvoiced speech source signal, and a vocal tract filter means selectively driven by the voiced speech source signal outputted from the voiced speech source generating means and the unvoiced speech source signal from the unvoiced speech source generating means to generate synthetic speech.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 1 is a block diagram of a text synthesis system related to the present invention;

FIGS. 3A to 3C are waveform diagrams to help explain the way of forming a typical waveform stored in the typical waveform memory in the embodiment;

DETAILED DESCRIPTION OF THE PREFERRED EMBODIMENTS

Figure 2:
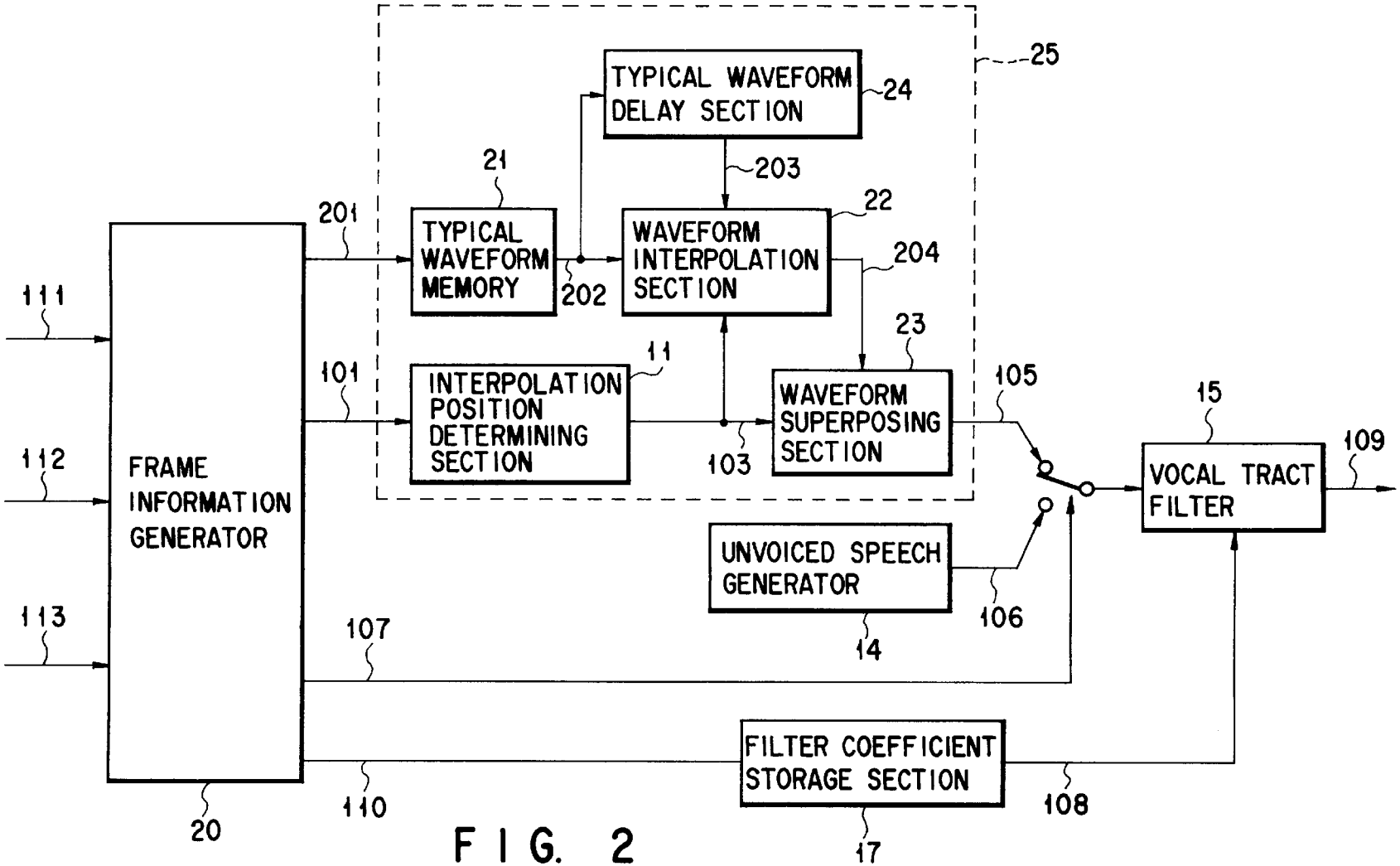
FIG. 2 is a block diagram of a speech synthesis apparatus according to a first embodiment of the present invention.

FIG. 1 shows a text-to-speech synthesis system to which the present invention is applied. The text-to-speech synthesis system, which performs text-to-speech synthesis whereby a speech signal is produced artificially from a given sentence, is composed of three stages: a speech processor 1, a phoneme processor 2, and a speech synthesis section 3. The speech processor 1 makes a Morphological analysis and a syntax analysis of the inputted text. The phoneme processor 2 performs the process of putting the accent and intonation on the analyzed data obtained from the speech processor 1 and generates information including a phoneme symbol string 111, a pitch pattern 112, phoneme duration 113, etc. Finally, the speech synthesis section 3, that is, the speech synthesis apparatus of the present invention, selects the feature parameters of small basic units (synthesis unit), including a syllable, a phoneme, and a one-pitch interval, according to information including. a phoneme symbol string, a pitch pattern, and phoneme duration and connects them by controlling their pitch and duration, thereby producing synthetic speech.

The speech synthesis apparatus according to a first embodiment of the present invention will be described with reference to FIG. 2.

The speech synthesis apparatus includes a frame information generator 20, a voiced speech source generator 25, an unvoiced speech source generator 14, and a vocal tract filter 15. According to the phoneme symbol string 111, the pitch pattern 112 and the phoneme duration 113, the frame information generator 20 outputs frame average pitch information 101, residual signal waveform selecting information 201, voiced/unvoiced discrimination information 107, and filter coefficient selecting information for each frame to be synthesized. The voiced speech source generator 25 generates a voiced speech source signal 105 on the basis of the frame average pitch information 101 and the residual signal waveform selecting information 201 in a voiced interval judged according to the voiced/unvoiced discrimination information 107. The details of the voiced speech source generator 25 will be described later. The unvoiced speech source generator 14 outputs an unvoiced speech source signal 106 expressed by white noise, in an unvoiced interval judged according to the voiced/unvoiced discrimination information 107. The vocal tract filter 15 approximates the vocal tract characteristic specified by the vocal tract characteristic information 108 and is driven by the voiced speech source signal 105 or unvoiced speech source signal 106, thereby producing a synthetic speech signal 109.

The residual signal waveform selecting information 201 is determined by, for example, the phonemes (e.g., /a/, /i/, /u/, /e/, /o/) of the speech signal to be synthesized corresponding to a given sentence, and specifies the residual signal waveform corresponding to the phonemes.

It is assumed that each phoneme of a speech signal is made up of at least one frame (usually, a plurality of frames) and the typical waveform corresponding to each frame is previously formed by, for example, analyzing the corresponding phoneme in a speech database and stored in a typical waveform memory 21. As an example, in the case of the phoneme /a/, the phoneme /a/ is first segregated from the speech database as shown in FIG. 3A. Then, a linear prediction analysis of the phoneme is made to produce the prediction error signal as shown in FIG. 3B. Since the voiced speech source signal is a periodic signal, each frame has a waveform for one to several periods. Then, as shown in FIG. 3C, a prediction error signal waveform for one pitch period is segregated as a typical waveform from one or more frames composing a phoneme. In the example of FIG. 3C, for the phoneme /a/, three typical waveforms are stored in the memory 21.

Hereinafter, the configuration and operation of the voiced speech source generator 25 will be explained in detail. The voiced speech source generator 25 of the embodiment is characterized in that, instead of generating a voiced speech source signal by repeating a single typical waveform in a frame as in the prior art, it generates a voiced speech source signal 105 whose waveform varies continuously between frames by obtaining through interpolation a typical waveform for the portion between two consecutive frames.

In the voiced speech source generator 25, an interpolation position determining section 11 is supplied with pitch period information 101 specifying the pitch period of a speech signal to be synthesized. The interpolation position determining section 11 determines an interpolation position so that the distance between waveform interpolation positions may be equal to the pitch period specified by the pitch period information 101 and outputs interpolation position designating information 103.

The typical waveform memory 21, as shown in FIG. 3C, stores typical waveforms representative of each frame of the residual signal waveform to make a voiced speech source signal in such a manner that more than one typical waveform corresponds to each phoneme. A first typical waveform 202 corresponding to the phoneme specified by the residual signal waveform selecting information 201 is read from the typical waveform memory 21 and outputted. A typical waveform delay section 24 generates a second typical waveform 203 by delaying the first typical waveform 202 for one frame. The first typical waveform 201 corresponds to the i-th frame of the speech signal of a phoneme, and the second typical waveform 203 corresponds to the (i-1)th frame of the speech signal of the same phoneme. Namely, the first typical waveform 202 and the second typical waveform 203 correspond to two consecutive frames.

From the first typical waveform 202 from the typical waveform memory 21 and the second typical waveform 203 from the typical waveform delay section 24, a waveform interpolation section 22 obtains by interpolation the residual signal waveforms corresponding to the interpolation positions extending over the two consecutive frames, or the i-th frame and the (i-1)th frame, determined at the interpolation position determining section 11, and generates a train 204 of residual signal waveforms each corresponding to the respective interpolation positions specified by the interpolation position information 103.

The waveform processing section 23 generates a final voiced speech source signal 105 to drive the vocal tract filter 15 by placing the corresponding residual signal waveforms in the residual signal waveform train 204 in the interpolation positions specified by the interpolation position information 103 to superpose them.

Explained next will be the operation of the interpolation position determining section 11. Consider a case that the pitch period specified by the pitch period information 101 is expressed by p and a voiced speech source signal from time t1 to time t2 is to be generated. In this case, the interpolation position determining section 11 determines N ($N \geqq 0$) interpolation positions $m_k$ ($m_1, m_2, \ldots, m_N$) between time $t=t_1$ to $t=t_2$ using the following equation (1) and outputs the interpolation position designating information 103:

$$m_k=m_0+pk(k=1, 2, \ldots, N) \quad (1)$$

where $m_0$ represents the interpolation position at the latest time in the interpolation positions already determined in the range of $t<t_1$.

Figure 4:
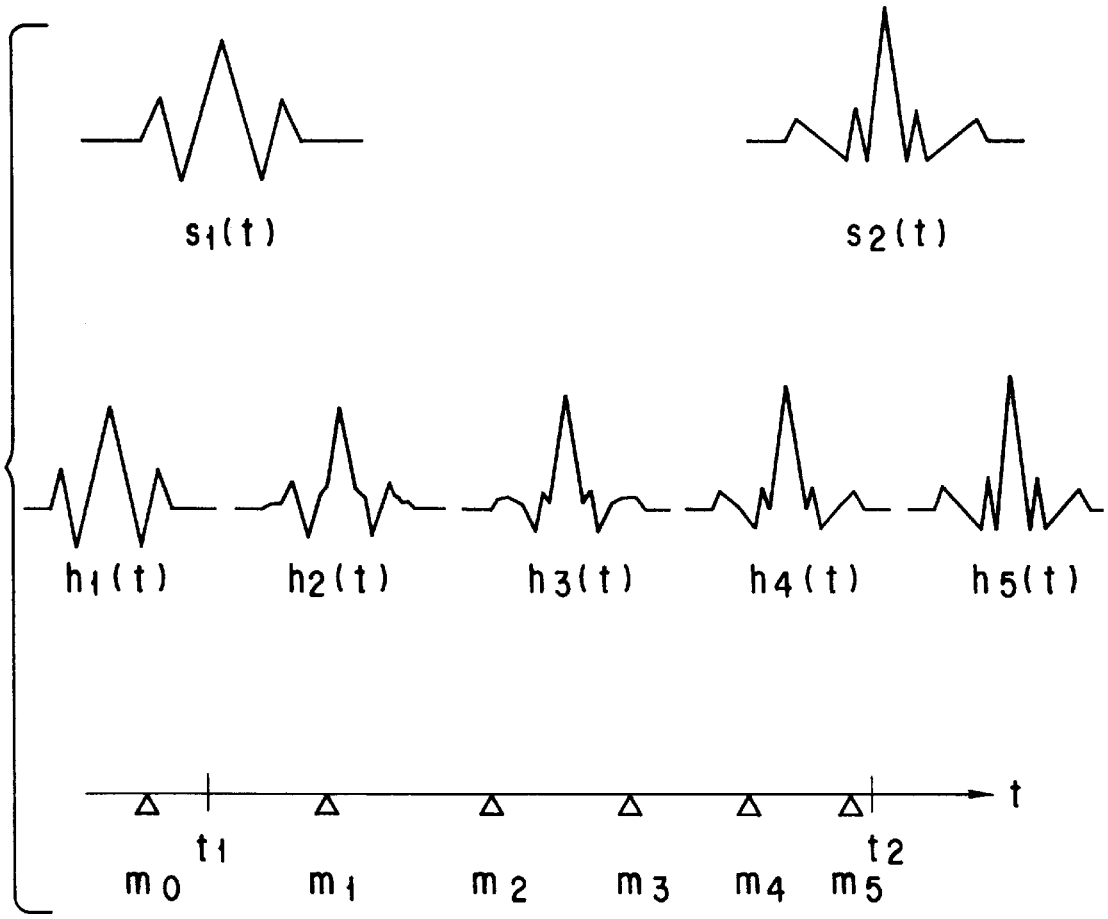
FIG. 4 is waveform diagrams to help explain the waveform interpolation processing in the embodiment.

Next, the operation of the waveform interpolation section 22 will be described with reference to FIG. 4. Let the first typical waveform 202 be expressed as $s_1(t)$ and the second typical waveform 203 be expressed as $s_2(t)$. The waveform interpolation section 22 calculates the corresponding residual signal waveforms $h_1(t)$, $h_w(t)$, . . . , $h_N(t)$ corresponding to the respective interpolation positions $m_1$, $m_2$, . . ., $m_N$ specified by the interpolation position designating information 103, using the following equation (2), and outputs these waveforms in the form of a residual signal waveform train 204:

$$h_k(t)=a(m_k)s_1(t)+\{(1-a(m_k)\}s_2(t) \quad (2)$$

where $a(m_k)$ is a weight coefficient changing smoothly. As an example, when it changes linearly, it is expressed by the following equation (3):

$$a(m_k)=(t_2-m_k)/(t_2-t_1) \quad (3)$$

The residual signal waveform train 204 is outputted serially in the order of interpolation positions $m_1, m_2, \ldots, m_N$, or is outputted in parallel.

Next, the operation of the waveform processing section 23 will be explained. Using the waveform interpolation positions $m_k$ (k=1, 2, . . . , N) specified by the interpolation position designating information 103 and the residual signal waveform train 204 from the waveform interpolation section 22, $h_k(t)$ (k=1, 2, . . . , N), the waveform processing section 23 calculates a voiced speech source signal 105 expressed by v(t) using the following equation (4):

$$v(t) = \sum_{k-1}^{N} h_k(t - m_k) \quad (4)$$

Specifically, the waveform processing section 23 performs superposition by arranging the residual signal waveform train 204($h_k$) from the waveform interpolation section 22 in the temporal positions represented by waveform interpolation positions $m_k$. In this case, the central portions of the residual signal waveforms placed in the adjacent interpolation positions are outputted independently, whereas the feet of the waveforms are added to each other, with the result that the continuity of the waveform of the produced voiced speech source signal 105 is improved much further.

As described above, according to the embodiment, the waveform interpolation section 22 obtains the residual signal waveform train 204 of the voiced speech source signal waveforms of the portion between two consecutive frames through interpolation from the first typical waveform 202 and second typical waveform 203 representative of the voiced speech source signals of the consecutive frames outputted from the typical waveform memory 21. Then, the waveform processing section 23 performs superposition by arranging the residual signal waveforms in the interpolation positions between the two consecutive frames determined at the interpolation position determining section 11, thereby producing the voiced speech source signal 105 to drive the vocal tract filter 15. Consequently, it is possible to obtain synthetic speech whose power spectrum changes smoothly and whose phonemes change continuously.

Next, a speech synthesis apparatus according to a second embodiment of the present invention will be described with reference to FIG. 5. The speech synthesis apparatus comprises a frame information generator 20, a voiced speech source generator 30 connected to the frame information generator, an unvoiced speech source generator 14, a filter coefficient memory 17 accessed by the frame information generator 20, and a vocal tract filter 15 selectively connected to the voiced speech source generator 30 and unvoiced speech source generator 14 by a switch controlled by the control signal from the frame information generator 20.

The voiced speech source generator 30 comprises a typical waveform memory 12 storing the typical waveforms and accessed by the frame information generator 20, a waveform processing section 13 connected to the output terminal of the typical waveform memory 12, a pitch interpolation section 32 and a pitch delay section 33 which are connected to the output terminal of the frame information generator 20, and an interpolation position determining section 31 connected between the pitch interpolation section 32 and the waveform processing section 13.

Figure 5:
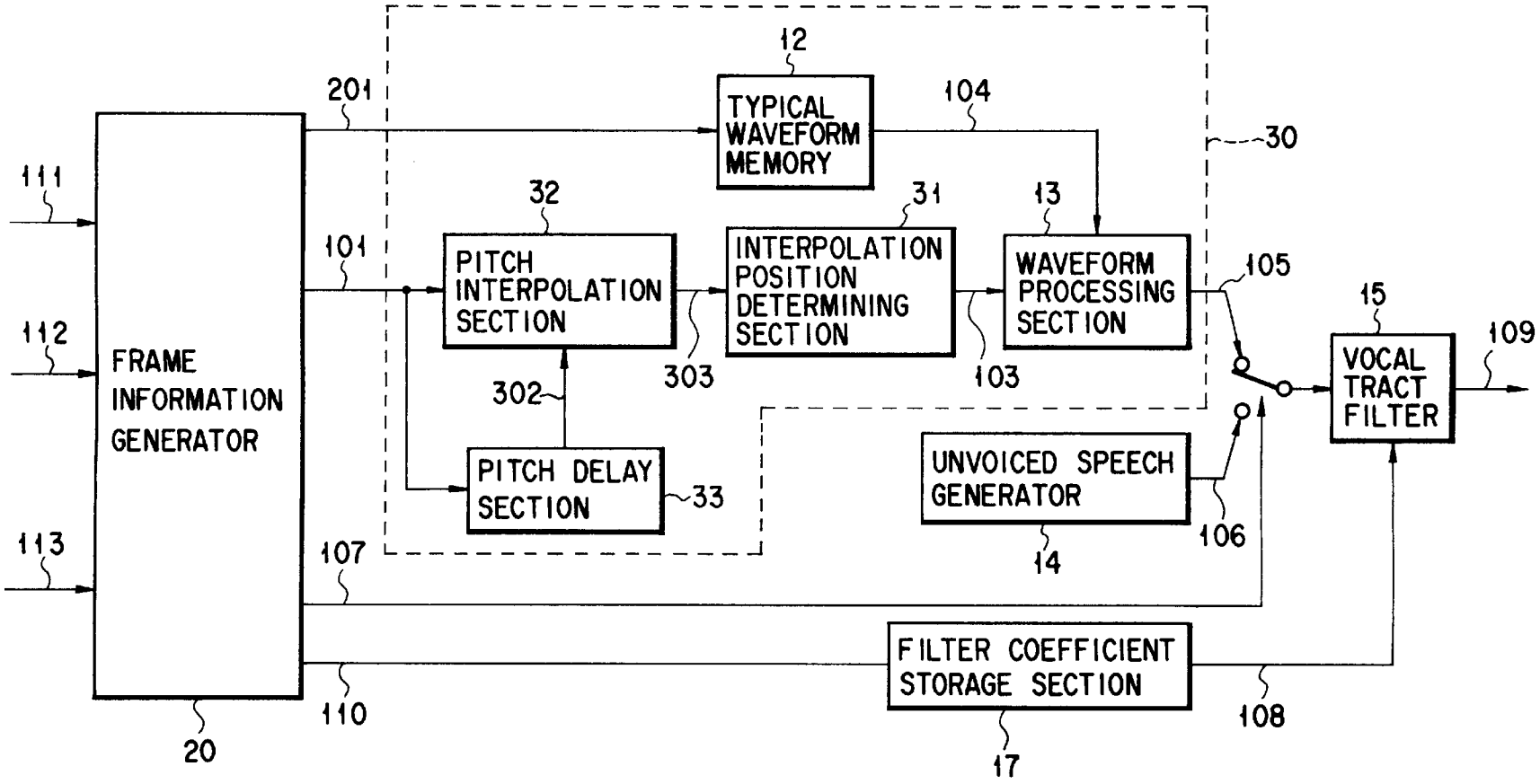
FIG. 5 is a block diagram of a speech synthesis apparatus according to a second embodiment of the present invention.

In the speech synthesis apparatus shown in FIG. 5, in a voiced interval determined by voiced/unvoiced discrimination information 107, the voiced speech source generator 30 generates a voiced speech source signal 105 on the basis of the first pitch period information 101 and second pitch period information 302 specified as the average pitches of two consecutive frames. The unvoiced speech source generator 14 outputs an unvoiced speech source signal 106 expressed by white noise in an unvoiced interval determined by the voiced/unvoiced discrimination information 107 as in the preceding embodiment. The vocal tract filter 15 approximates the vocal tract characteristic specified by the vocal tract characteristic information 108 and is driven by the voiced speech source signal 105 or unvoiced speech source signal 106, thereby producing a synthetic speech signal 109.

Hereinafter, the operation of the voiced speech source generator 30 will be explained in detail. Instead of generating a voiced speech signal by superposing typical waveforms at regular intervals in a frame, the second embodiment obtains by interpolation the pitch period of the portion between the two frames from a first pitch period and a second pitch period specified as the pitch periods of two consecutive frames, and generates a voiced speech source signal with a pitch period string that changes smoothly from the first pitch period to the second pitch period.

In the voiced speech source generator 30, the first pitch period information 101 is supplied to a pitch delay section 33, which outputs the second pitch period information 302 delayed one frame from the first pitch period information 101. Then, the first pitch period information 101 and second period information 302 are supplied to a pitch interpolation section 32. The pitch interpolation section 32 performs pitch-interpolation on the basis of the first pitch period specified by the pitch period information 101 and the second pitch period specified by the pitch period information 302 so that the pitch periods corresponding to two consecutive frames consecutively change smoothly for each pitch period, and determines a pitch period string 303.

An interpolation position determining section 31 determines interpolation positions, so that the distance between these interpolation positions change consecutively according to the pitch period string 303, and then decides interpolation position information 103.

A typical waveform memory 12 stores more than one typical waveform representative of the frame of the residual signal waveform to be used for a voiced speech source signal so that they correspond to each phoneme, and selectively reads and outputs the typical waveforms 104 according to residual signal waveform selecting information 201.

A waveform processing section 13 performs superposition by arranging the typical waveforms 104 in the corresponding interpolation positions indicated by the interpolation position information 103, thereby generating a final voiced speech source signal 105 for driving the vocal tract filter 15.

Figure 6:
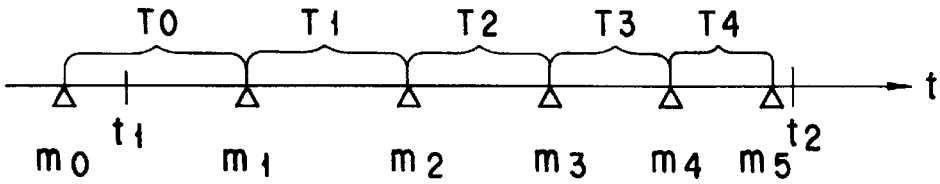
FIG. 6 is a waveform diagram to help explain the pitch interpolation processing in the embodiment.

Next, the operation of the pitch interpolation section 32 will be described with reference to FIG. 6. In FIG. 6, it is assumed that the pitch period at time t2 is the first pitch period specified by the first pitch period information 101 and the pitch period at time $t_1$ is the second pitch period specified by the second pitch period information 302. The first pitch period is represented by $p_2$ and the second pitch period is expressed by $p_1$. As shown in FIG. 6, it is assumed that the interpolation position at the latest time in the interpolation positions already determined in the range of $t<t_1$ is $m_0$ and the interpolation positions in the range of $t_1 \leqq t<t_2$ are $m_k$ ($m_1, m_2, \ldots, m_N$).

Here, if $p_1=p_2$, the pitch period obtained by interpolation will be always equal to $p_1$. Therefore, only the case of $p_1 \neq p_2$ will be considered. In this case, the pitch period p(t) at time t is expressed by the following equation (5):

$$p(t)=a(t)p_1+(1-a(t))p_2 \tag{5}$$

where a(t) is a weight coefficient that changes smoothly. As an example, when it changes linearly, it is expressed by the following equation (6):

$$a(t)=(t2-t1)/(t2-t1) \tag{6}$$

The period $T_k$ from an interpolation position $m_k$ to the next interpolation position $m_k+1$ is the solution to equation (7):

$$\int_{m_k}^{m_k+T_k} \frac{2\pi}{p(t)} = 2\pi \tag{7}$$

Solving equation (7) gives the following equations (8), (9), and (10):

$$T_k = (m_k + \alpha)(e^{1/\beta} - 1) \tag{8}$$

$$\alpha = (p_1 t_2 - p_2 t_1)/(p_2 - p_1) \tag{9}$$

$$\beta = (t_2 - t_1)/(p_2 - p_1) \tag{10}$$

Putting equation (11) to equation (8) gives equation (12):

$$m_k = m_o + \sum_{l=0}^{k-1} T_i \tag{11}$$

$$T_k = (m_o + \alpha)(e^{1/\beta} - 1)e^{k/\beta} \tag{12}$$

$T_0, T_1, \ldots, T_{N-1}$ obtained by computing equation (12) make the pitch period string 303.

Next, the operation of the interpolation position determining section 31 will be explained. The interpolation position determining section 31 calculates interpolation positions ($m_0, m_1, \ldots, m_{N-1}$) recurrently from the pitch period string 303 ($T_0, T_1, \ldots, T_{N-1}$) using the following equation (13):

$$m_k=m_{k-1}+T_{k-1} \tag{13}$$

As described above, according to the second embodiment, after the pitch interpolation section 32 has performed interpolation to the pitch period of consecutive frames, and thereby determined the pitch period string that changes smoothly for each period, the interpolation position determining section 31 determines interpolation positions according to the pitch period string. The typical waveforms corresponding to the interpolation positions are read from the typical waveform memory 12. Then, the waveform processing section 13 performs superposition by arranging the typical waveforms in the corresponding interpolation positions, and thereby produces a voiced speech source signal 105 for driving the vocal tract filter 15. Accordingly, it is possible to obtain synthetic speech whose pitch period string changes smoothly for each pitch period.

Figure 7:
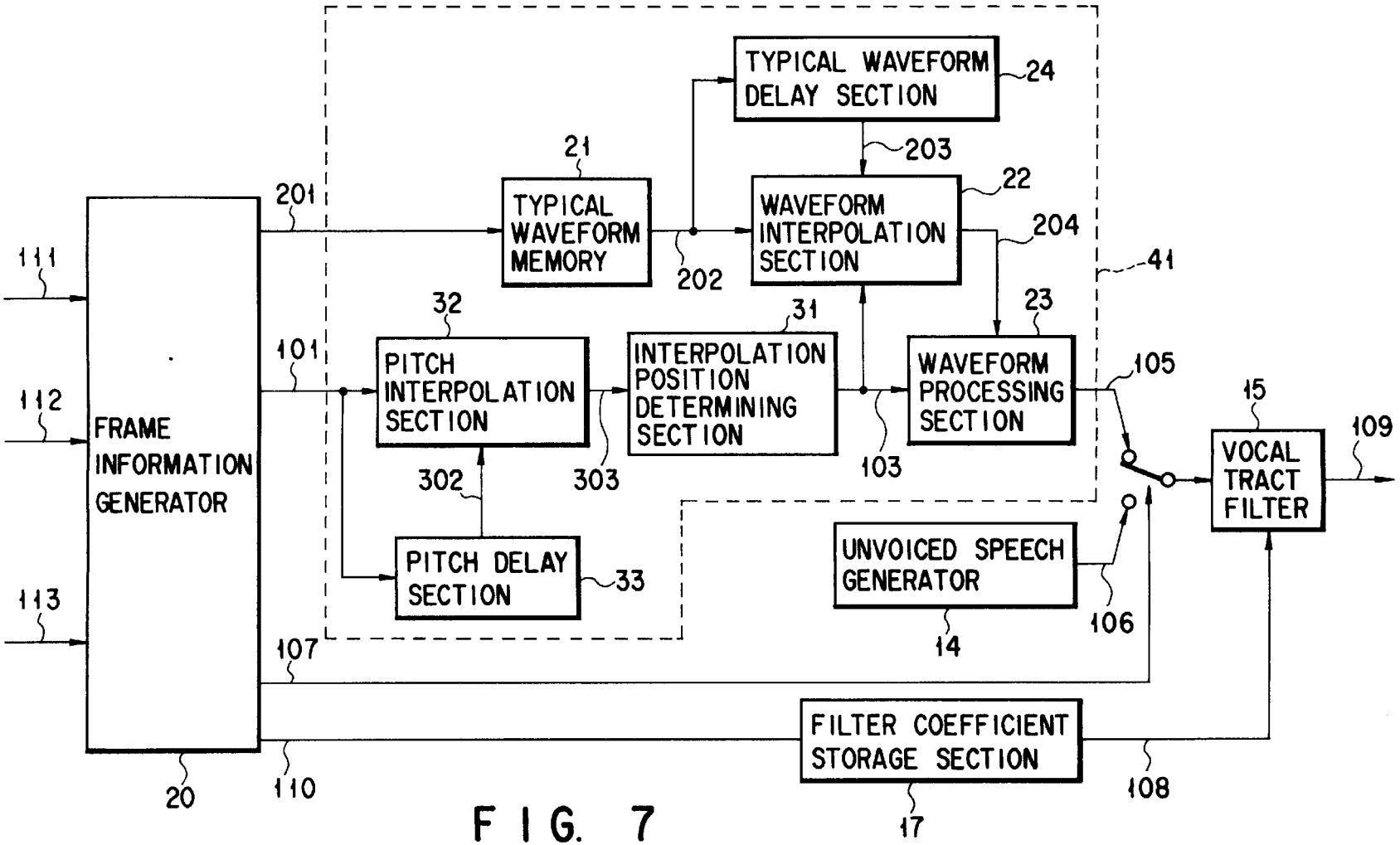
FIG. 7 is a block diagram of a speech synthesis apparatus according to a third embodiment of the present invention.

Hereinafter, a speech synthesis apparatus according to a third embodiment of the present invention will be explained with reference to FIG. 7. The speech synthesis apparatus is a combination of the speech synthesis apparatus of FIG. 2 and the speech synthesis apparatus of FIG. 5. The speech synthesis apparatus comprises a frame information generator 20, a voiced speech source generator 41, an unvoiced speech source generator 14, and a vocal tract filter 15. According to the phoneme symbol string 111, the pitch pattern 112, and the phoneme duration 113, the frame information generator 20 outputs frame average pitch information 101, residual signal waveform selecting information 201, voiced/unvoiced discrimination information 107, and filter coefficient selecting information 110 for each frame to be synthesized. The voiced speech source generator 41 generates a voiced speech source signal 105 on the basis of the first pitch period information 101 and the residual signal waveform selecting information 201 in a voiced interval determined by the voiced/unvoiced discrimination information 107. The unvoiced speech source generator 14 outputs an unvoiced speech source signal 106 expressed by white noise, in an unvoiced interval determined by the voiced/unvoiced discrimination information 107. The vocal tract filter 15 approximates the vocal tract characteristic specified by the vocal tract characteristic information 108 and is driven by the voiced speech source signal 105 or unvoiced speech source signal 106, thereby producing a synthetic speech signal 109.

Next, the operation of the voiced speech source generator 41 of the third embodiment will be explained. Instead of generating a voiced speech source signal by repeating a single typical waveform in a frame as in the prior art, the voiced speech source generator 41 of the third embodiment generates a voiced speech source signal whose waveform varies continuously between frames by performing interpolation to typical waveforms of the portion between two consecutive frames. Furthermore, instead of generating a voiced speech source signal by superposing typical waveforms at regular intervals in a frame, the voiced speech source generator 41 of the third embodiment obtains by interpolation the pitch period of the portion between the two frames from a first pitch period and a second pitch period specified as the pitch periods of two consecutive frames, and generates voiced speech source signals with a pitch period string that changes smoothly from the first pitch period to the second pitch period for each pitch period or in units of a predetermined number of pitch periods.

In the voiced speech source generator 41, the first pitch period information 301 and the second pitch period information 302 are supplied to a pitch interpolation section 32. From the first pitch period specified by the pitch period information 301 and the second pitch period specified by the pitch period information 302, the pitch interpolation section 32 performs interpolation to the pitch period so that the pitch periods corresponding to two consecutive frames consecutively change smoothly, and outputs a pitch period string 303.

The interpolation position determining section 31 determines interpolation positions so that the distance between these interpolation positions change consecutively according to the pitch period string 303 and then decides interpolation position information 103.

The typical waveform memory 21, as shown in FIG. 3C, stores typical waveforms representative of the frame of the residual signal waveform to make a voiced speech source signal in such a manner that more than one typical waveform corresponds to each phoneme. A first typical waveform 202 corresponding to the phoneme specified on the basis of the residual signal waveform selecting information 201 is selectively read from the typical waveform memory 21 and outputted. A typical waveform delay section 24 generates a second typical waveform 203 by delaying the first typical waveform 202 for one frame. Here, it is assumed that the first typical waveform 202 corresponds to the i-th frame of the speech signal of a phoneme, and the second typical waveform 203 corresponds to the (i−1)th frame of the speech signal of the same phoneme. Namely, the first typical waveform 202 and the second typical waveform 203 correspond to two consecutive frames.

From the first typical waveform 202 from the typical waveform memory 21 and the second typical waveform 203 from the typical waveform delay section 24, a waveform interpolation section 22 obtains by interpolation a residual signal waveform corresponding to the interpolation positions between the two consecutive frames, or the i-th frame and the (i+1)th frame, determined at the interpolation position determining section 11, and generates a train 204 of residual signal waveforms corresponding to the respective interpolation positions specified by the interpolation position information 103.

The waveform processing section 23 generates a final voiced speech source signal 105 to drive the vocal tract filter 15 by placing the corresponding residual signal waveforms in the residual signal waveform train 204 in the interpolation positions specified by the interpolation position information 103 to superpose them.

Since the waveform interpolation section 22 and waveform processing section 23 are the same as those explained in the first embodiment, and the pitch interpolation section 32 and waveform processing section 31 are the same as those in the second embodiment, a more detailed explanation will not be given.

As described above, according to the third embodiment, after the pitch interpolation section 32 has performed interpolation to the pitch period of consecutive frames, and thereby determined the pitch period string that changes smoothly for each pitch period, the interpolation position determining section 31 determines interpolation positions according to the pitch period. The waveform interpolation section 22 obtains the residual signal waveform train 204 of the voiced speech source signal waveforms for the portion extending over two consecutive frames through interpolation from the first typical waveform 202 and second typical waveform 203 representative of the voiced speech source signal of the consecutive frames. Then, the waveform processing section 23 performs superposition by arranging the residual signal waveforms 204 in the interpolation positions extending over the two consecutive frames determined at the interpolation position determining section 31, thereby producing the voiced speech source signal 105 to drive the vocal tract filter 15. This makes it possible to obtain synthetic speech whose power spectrum changes smoothly and whose phonemes change continuously.

Figure 8:
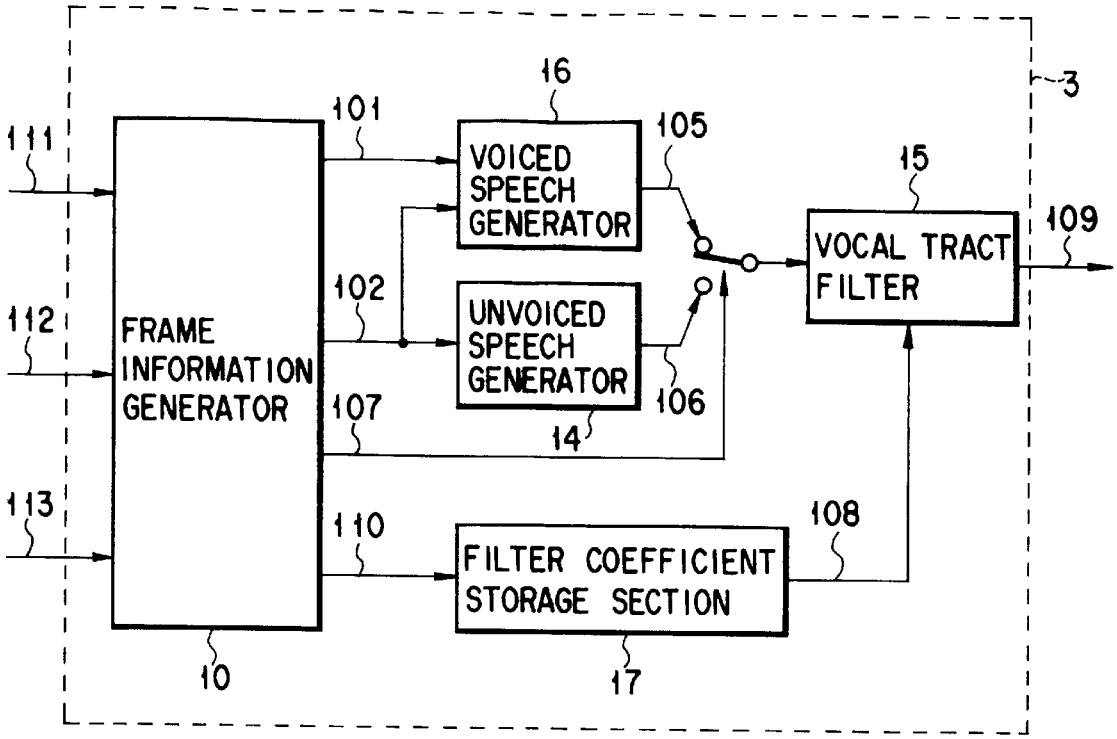
FIG. 8 is a block diagram of a speech synthesis apparatus according to a fourth embodiment of the present invention.

A fourth embodiment, as shown in FIG. 8, of the embodiment is such that in the speech synthesis apparatus of the first embodiment explained in FIG. 2, the typical waveform memory 21 stores the typical waveforms representative of the frame of the residual signal that are made to have a zero phase. For example, if what is obtained by making the typical waveform s(t) have a zero phase is s'(t), s'(t) can be calculated as follows.

First, the frequency spectrum S(ω) of s(t) is calculated by Fourier transformation:

$$S(\omega)=F(s(t)) \tag{14}$$

Then, the absolute value S'(ω) of S(ω) is calculated:

$$S'(\omega)=|S(\omega)| \tag{15}$$

Finally, s'(t) is calculated by inverse Fourier transformation of S'(ω):

$$s'(t)=F^{-1}(S'(\omega)) \tag{16}$$

As described above, with the fourth embodiment, the typical waveforms stored in the typical waveform memory 21 are made to have a zero phase, causing, for example, the power spectrum of the residual signal waveform $h_k(t)$ generated by interpolation of equation (2) to equal what is obtained by interpolating the power spectrums of the typical waveforms $s_1(t)$ and $s_2(t)$. Therefore, interpolation to the waveform provides the advantages that a smoothly changing power spectrum can be realized easily and a phoneme changes smoothly.

A fifth embodiment of the embodiment is such that in the speech synthesis apparatus of the third embodiment explained in FIG. 5, the typical waveform memory 21 stores the typical waveforms of the frame of the residual signal that are made to have a zero phase. Making the typical waveforms have a zero phase can be achieved by the method explained in the fourth embodiment, for example. As with the third embodiment, with the fifth embodiment, interpolation to the waveform is achieved by making the typical waveforms have a zero phase, resulting in the advantages that a smoothly changing power spectrum can be realized easily and a phoneme changes smoothly.

A sixth embodiment of the embodiment is such that in the speech synthesis apparatus of the first or third embodiment, a waveform interpolation section 22 makes a first typical waveform 202 and a second typical waveform 203 have a zero phase and performs interpolation to these waveforms, thereby producing a residual signal waveform train 204.

A seventh embodiment of the embodiment is such that in the speech synthesis apparatus of the first or third embodiments, a waveform interpolation section 22 performs Fourier transformation of a first typical waveform 202 and a second typical waveform 203 into a frequency spectrum and then performs inverse Fourier transformation of the frequency spectrum obtained by interpolation to the absolute value and phase of the spectrum, thereby producing a residual signal waveform train 204.

Figure 9:
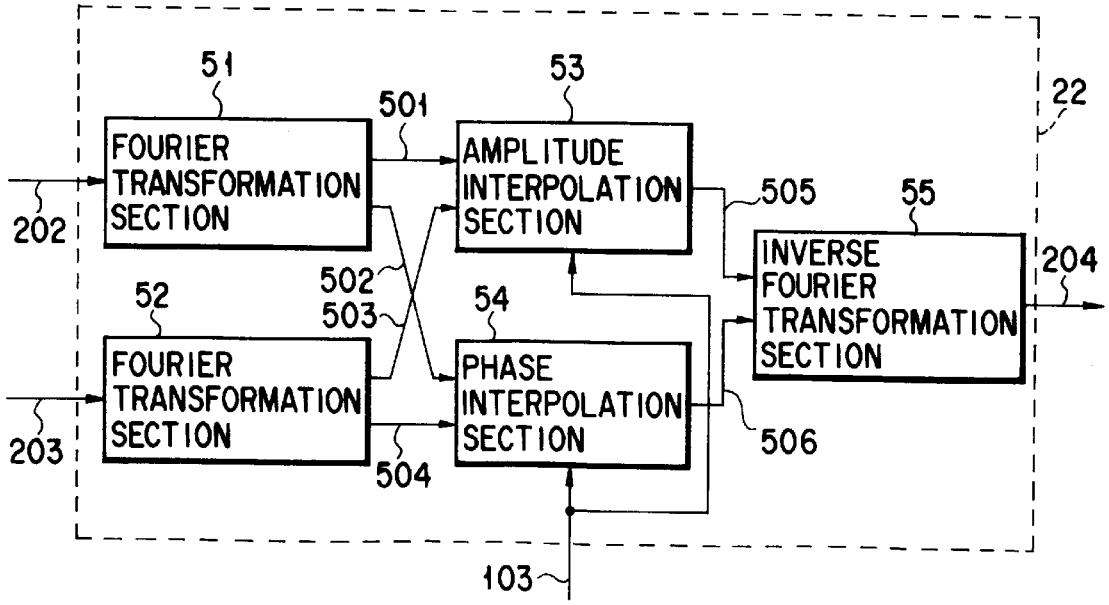
FIG. 9 is a block diagram of the waveform interpolation section.

FIG. 9 shows an example of the waveform interpolation section. In the figure, a Fourier transformation section 51 performs Fourier transformation of the first typical waveform 202 to get a frequency spectrum and outputs its amplitude component 501 and phase component 502. Similarly, a Fourier transformation section 52 performs Fourier transformation of the second typical waveform 203 to get a frequency spectrum and outputs its amplitude component 503 and phase component 504. The amplitude interpolation section 53 performs interpolation between the amplitude component 501 and amplitude component 503 by giving a weight according to the interpolation positions specified by the interpolation position designating information 103 and outputs an amplitude component 505. Similarly, the phase interpolation section 54 performs interpolation between the phase component 502 and phase component 504 by giving a weight according to the interpolation positions specified by the interpolation position designating information 103 and outputs a phase component 506. The inverse Fourier transformation section 55 performs inverse Fourier transformation of the frequency spectrum composed of the amplitude component 505 and phase component 506 and outputs a residual signal waveform train 204.

An eighth embodiment of the embodiment is such that in the speech synthesis apparatus of the first or third embodiment, a typical waveform memory 21 stores the frequency spectrum of the typical waveform representative of the frame of the residual signal, and a waveform interpolation section 22 performs inverse Fourier transformation of the frequency spectrum obtained by interpolating the absolute values and phases of the frequency spectrum 202 of a first typical waveform and the frequency spectrum 203 of a second typical waveform, thereby producing a residual signal waveform train 204.

A ninth embodiment of the embodiment is such that in the speech synthesis apparatus of the first or third embodiment, a pitch interpolation section 32 performs interpolation between the pitches so that the reciprocal of the pitch period, or the pitch frequency, change linearly. In this case, a pitch period string 303 is calculated using the following equations (17), (18), and (19):

$$Tk = \begin{cases} \frac{1}{2}\{-(2m_k+\alpha')+\sqrt{(2m_k+\alpha')2+4\beta'}\}(p_1>p_2) \\ \frac{1}{2}\{-(2m_k+\alpha')+\sqrt{(2m_k-\alpha')2+4\beta'}\}(p_1>p_2) \end{cases} \quad (17)$$

$$\alpha' = \frac{2(p_2t_2-p_1t_1)}{(p_1-p_2)} \quad (18)$$

$$\beta' = \frac{2p_1p_2(t_2-t_1)}{(p_1-p_2)} \quad (19)$$

As explained above, with the present invention, it is possible to provide a speech synthesis apparatus capable of producing a natural synthetic speech with good continuity whose phonemes and pitches both change smoothly.

Figure 10:
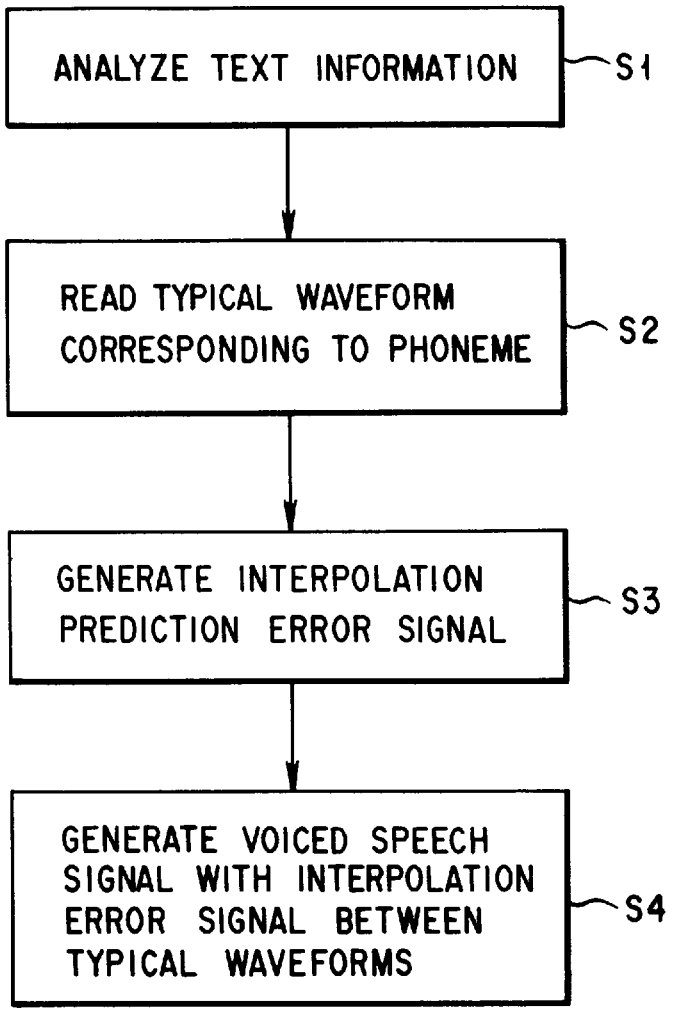
FIG. 10 is a flowchart of the steps of speech synthesis in a speech synthesis apparatus of the present invention.

Specifically, with the invention, as shown in the flowchart of FIG. 10, text information is first analyzed (step S1). On the basis of the analysis result, the typical waveforms corresponding to the phonemes of a plurality of frames are read from the memory (step S2). Then, interpolation between consecutive frames is performed using the corresponding typical waveforms, thereby generating a plurality of interpolation prediction error signals (step S3). In this case, interpolation is performed so that the phonemes change smoothly between consecutive frames, for example, the pitch period or/and interpolation signal level may change smoothly between consecutive frames.

The predictive interpolation signals are placed between the typical waveforms of consecutive frames, thereby producing a voiced speech source signal that changes smoothly (step S4).

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A speech synthesis apparatus comprising:

a memory for storing a plurality of typical waveforms corresponding to a plurality of frames, the typical waveforms each previously obtained by extracting in units of at least one frame from a prediction error signal formed in predetermined units;

a voiced speech source generator including an interpolation circuit for performing interpolation between the typical waveforms readout from said memory to obtain a plurality of interpolation signals each having at least one of an interpolation pitch period and a signal level which changes smoothly between the corresponding frames, and a superposing circuit for superposing the interpolation signals obtained by said interpolation circuit to form a voiced speech source signal;

an unvoiced speech source generator for generating an unvoiced speech source signal; and vocal tract filter selectively driven by the voiced speech source signal outputted from said voiced speech source generator and the unvoiced speech source signal from said unvoiced speech source generator to generate synthetic speech.

2. A speech synthesis apparatus according to claim 1, wherein said voiced speech source generator includes a typical waveform storage for storing a plurality of typical waveforms representative of the plurality of frames, respectively, in units of at least one phoneme, and said interpolation circuit performs interpolation between the typical waveforms so that the the voiced speech source signal changes smoothly.

3. A speech synthesis apparatus according to claim 1, wherein said interpolation circuit includes means for performing interpolation by weighting the typical waveforms with weight coefficients making the voiced speech source signal change smoothly.

4. A speech synthesis apparatus according to claim 1, wherein said interpolation circuit includes a Fourier transformer for Fourier-transforming consecutive ones of the typical waveforms to a frequency vector to output a frequency spectrum signal corresponding to the typical waveforms, and an inverse Fourier transformer for inverse-Fourier-transforming the frequency spectrum by interpolating an absolute value of the frequency spectrum signal and a phase thereof.

5. A speech synthesis apparatus according to claim 1, wherein said interpolation circuit comprises a pitch information generator for generating first pitch period information and a second pitch period information delayed for at least one frame from the first pitch period information, and a pitch period interpolation circuit for interpolating the pitch period so that the pitch periods corresponding to two consecutive frames may change smoothly, on the basis of the first pitch period specified by said first pitch period information and the second pitch period specified by said second pitch period information from said pitch information generator.

6. A speech synthesis apparatus according to claim 1, wherein said typical waveform storage stores typical waveforms each having a zero phase for obtaining a symmetrical wave.

7. A speech synthesis apparatus according to claim 1, wherein said interpolation circuit includes a typical waveform interpolation circuit for performing interpolation to the typical waveforms so that the typical waveforms read from said typical waveform storage and corresponding to consecutive frames change smoothly, and a pitch interpolation circuit for interpolating a gap between the typical waveforms, and said pitch interpolation circuit includes a pitch information generator for generating first pitch period information and second pitch period information delayed for one frame from the first pitch period information, and a pitch period interpolation circuit for performing interpolation between the typical waveforms so that the pitch period corresponding to two consecutive frames change smoothly, on the basis of the first pitch period specified by said first pitch period information and the second pitch period specified by said second pitch period information from said pitch information generator.

8. A speech synthesis apparatus according to claim 7, wherein said typical waveform storage stores typical waveforms each having a zero phase for obtaining a symmetrical wave.

9. A speech synthesis apparatus according to claim 7, wherein said interpolation circuit comprises a Fourier transformer for performing Fourier transformation of the consecutive typical waveforms into a frequency spectrum and outputs a frequency spectrum signal corresponding to the typical waveforms and an inverse Fourier transformer for performing inverse Fourier transformation of the frequency spectrum by performing interpolation to an absolute value of the frequency spectrum signal and a phase thereof.

10. A speech synthesis apparatus comprising:

a typical waveform storage storing a plurality of typical waveforms each representative of individual frames of voiced speech source signals obtained by dividing a time-sequence signal into specific frame units and outputs a typical waveform selected according to waveform selection information given for each frame in accordance with a speech signal to be synthesized;

an interpolation position determining circuit for determining the interpolation positions extending over two consecutive frames on the basis of the pitch period given in accordance with the speech signal to be synthesized;

a waveform interpolation circuit for forming a plurality of voiced speech waveforms corresponding to the interpolation positions determined by said interpolation position determining circuit by performing interpolation to the typical waveforms corresponding to the two consecutive frames outputted from said typical waveform storage;

a waveform superposing circuit for superposing the voiced speech source signal waveforms obtained by said waveform interpolation circuit and corresponding to the interpolation positions determined by said interpolation position determining circuit, to obtain a voiced speech source signal; and a vocal tract filter driven by said voiced speech source signal for generating synthetic speech.

11. A speech synthesis apparatus comprising:

a typical waveform storage for storing a plurality of typical waveforms each representative of individual frames of voiced speech source signals obtained by dividing a time-sequence signal into specific frame units and outputs a plurality of typical waveforms selected according to waveform selecting information given for each frame in accordance with a speech signal to be synthesized;

a pitch interpolation circuit for interpolating a pitch period given to the typical waveforms so that the pitch periods corresponding to two consecutive frames change smoothly, on the basis of the pitch period given to the typical waveforms for each frame in accordance with the speech signal to be synthesized;

an interpolation position determining circuit for determining the interpolation positions extending over two consecutive frames according to a plurality of interpolated pitch periods obtained by said pitch interpolation circuit;

waveform processing means for arranging the typical waveforms readout from said typical waveform storage at the interpolation positions determined at said interpolation position determining circuit, to obtain a voiced speech source signal; and a vocal tract filter section driven by said voiced speech source signal for generating synthetic speech.

12. A speech synthesis apparatus according to claim 11, which includes a waveform interpolation circuit for interpolating the typical waveforms corresponding to two consecutive frames to obtain interpolated waveforms corresponding to the interpolation positions determined by said interpolation position determining circuit, and wherein said waveform processing circuit arranges the interpolated waveforms at the determined interpolation positions.

13. A speech synthesis method comprising the steps of:

preparing a plurality of prediction error signals corresponding to phonemes of plural frames;

extracting a plurality of typical waveforms from the prediction error signals in predetermined units and storing the typical waveforms extracted in a storage;

interpolating the typical waveforms corresponding to consecutive frames so that the pitch period and signal waveform change smoothly between the consecutive frames to obtain interpolation signals;

forming a voiced speech source signal by superposing the interpolation signals;

forming an unvoiced speech source signal; and forming a synthesis speech in accordance with the voiced source signals and the unvoiced speech source signals.

14. A speech synthesis method according to claim 13, wherein said step of interpolation performs interpolation between the typical waveforms so that the pitch periods corresponding to the consecutive frames change smoothly.

15. A speech synthesis method according to claim 14, wherein said step of interpolation includes a step of weighting the typical waveforms with weight coefficients making said pitch periods change smoothly.

16. A speech synthesis method according to claim 13, wherein the step of interpolation includes a step of Fourier-transforming the consecutive typical waveforms to a frequency vector to output a frequency spectrum signal corresponding to the typical waveforms, and a step of inverse-Fourier-transforming the frequency spectrum by interpolating an absolute value of the frequency spectrum signal and a phase thereof.

17. A speech synthesis method according to claim 13, wherein said step of interpolation includes a step of generating first pitch period information and second pitch period information delayed for one frame from the first pitch period information, and a step of interpolating the pitch period so that the pitch periods corresponding to two consecutive frames change smoothly, on the basis of the first pitch period specified by said first pitch period information and the second pitch period specified by said second pitch period information.

18. A speech synthesis method according to claim 13, wherein said step of interpolation includes a step of performing interpolation to the typical waveforms so that the typical waveforms read from said storage and corresponding to consecutive frames change smoothly and a step of interpolating the pitch period of the typical waveforms, and said pitch interpolation step including generating first pitch period information and second pitch period information delayed for one frame from the first pitch period information, and the step of interpolating pitch period performs interpolation to the pitch period so that the pitch periods corresponding to two consecutive frames change smoothly, on the basis of the first pitch period specified by said first pitch period information and the second pitch period specified by the second pitch period information.

19. A speech synthesis system, comprising:

means for preparing a plurality of prediction error signals corresponding to phonemes of plural frames;

means for extracting a plurality of typical waveforms from the prediction error signals in predetermined units and storing the typical waveforms extracted in a memory;

means for interpolating the typical waveforms corresponding to consecutive frames so that the pitch period and signal waveforms change smoothly between the consecutive frames to obtain interpolation signals;

means for forming a voiced speech source signal by superposing the interpolation signals;

forming an unvoiced speech source signal; and forming a synthesis speech in accordance with the voiced source signals and the unvoiced speech source signals.

* * * * *